United States Patent [19]

Marbacher

[11] 4,121,324

[45] Oct. 24, 1978

[54] FASTENING DEVICE

[76] Inventor: Stephan Marbacher, Schmidgasse 2, 6300 Zug, Switzerland

[21] Appl. No.: 806,896

[22] Filed: Jun. 15, 1977

[30] Foreign Application Priority Data

Jun. 16, 1976 [CH] Switzerland ..... 7669/76

[51] Int. Cl.[2] ..... A44B 21/00

[52] U.S. Cl. ..... 24/73 MS; 24/201 B; 24/230 R

[58] Field of Search ..... 24/201 B, 73 MS, 222 R, 24/201 HE, 73 R, 230 R, 230 TC

[56] References Cited

U.S. PATENT DOCUMENTS

| | | | |
|---|---|---|---|
| 547,060 | 10/1895 | Bourke | 24/230 R |
| 3,063,118 | 11/1962 | Salter et al. | 24/201 B |
| 3,072,938 | 1/1963 | Phaneuf | 24/230 R |
| 3,111,737 | 11/1963 | Heil | 24/222 |
| 3,144,274 | 8/1964 | Harris | 24/201 B |

FOREIGN PATENT DOCUMENTS

| | | | |
|---|---|---|---|
| 76,435 of | 1919 | Australia | 24/201 HE |
| 2,419,407 | 11/1975 | Fed. Rep. of Germany | 24/201 B |

*Primary Examiner*—Kenneth J. Dorner

*Attorney, Agent, or Firm*—Pollock, Vande Sande and Priddy

[57] ABSTRACT

A magnetic fastening device comprises a fixed fastening component having a cam and a recess therein which is at least partially bounded by magnetic material, and a movable fastening component provided with a magnet dimensioned to fit into said recess. The fixed fastening component is arranged to provide a slideway adapted to receive the movable fastening component, the dimensions of the slideway being so related to the dimensions of the movable component that, when the magnet of the movable component is disposed within the recess of the fixed component, the magnet may be lifted out of said recess and the movable component may thereafter be drawn out of the slideway, by depressing the movable component toward a seat portion of the fixed component.

5 Claims, 10 Drawing Figures

FASTENING DEVICE

The invention refers to a fastening device for connecting two parts, for use in particular in conjunction with articles of clothing, the fastening components of said device being held together detachably by magnetic force developed by a magnet disposed therebetween. Such fastening devices are especially suited for belts, shoulder straps, safety belts, shoes, etc.

Such devices have been proposed in different varieties but they proved unsafe in operation, for they frequently opened accidentally due to weak magnetic forces. The present invention avoids the disadvantages of the known magnetic fastening devices. Its characterizing feature consists in that it comprises a fastening component provided with a cam and a recess, and a movable fastening component provided with a magnet, the two components forming a slideway bounded by a bottom part and lateral parts, the distance between the movable component and the bottom part being large enough to allow lifting of the magnet of the recess and sliding of the movable component out of the slideway by depressing the movable component down to its seat on the bottom part.

The drawing shows three exemplary embodiments of the invention, as follows.

Figure 2:
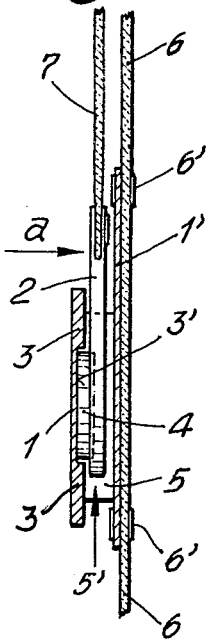
FIG. 2 shows a longitudinal section along the line XV—XV of FIG. 1.
Figure 3:
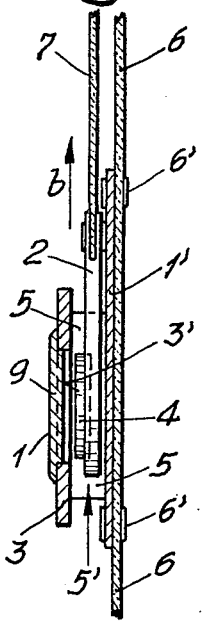
FIG. 3 shows a section through a partially modified version of the fastening device, along the line XV—XV of FIG. 1.
Figure 1:
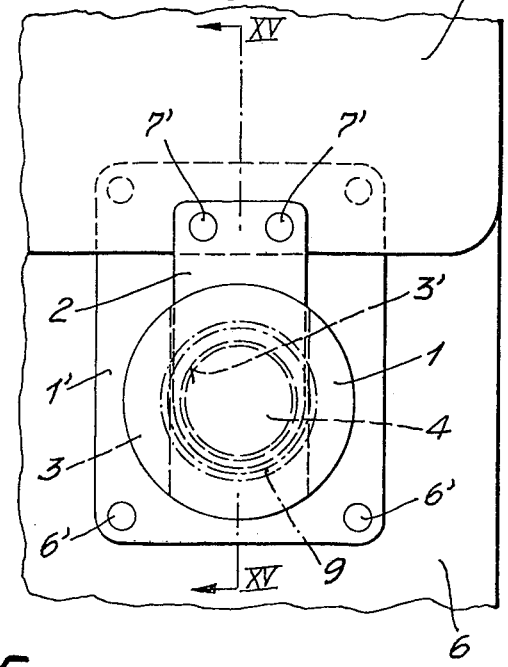
FIG. 1 shows a plan view of a first embodiment of the fastening device suited, for example, for portfolios and bags.

The fastening device according to FIGS. 1 to 3 comprises a bottom part 1′ to be fixedly secured by means of the rivets 6′ on the front part 6 of a bag, a portfolio, or the like, said bottom part 1′ forming together with the fixed fastening component 1 and the lateral parts 5 a slideway 5′ accommodating the movable fastening component 2 with the magnet 4. The fixed fastening component 1 is provided with a recess 3′ within a cam 3, whereas the movable fastening component 2, which is mounted by means of the rivets 7′ on the fastening flap 7 of the bag or the portfolio comprises a fixedly mounted countersunk magnet 4 disposed facing the recess 3′. The distance between the movable component 2 and the bottom part 1′ is designed to be large enough to allow lifting of the magnet 4 out of the recess 3′ and subsequent sliding of the movable fastening component 2 out of the slideway 5′ in the direction indicated in FIG. 3 by the arrow *b*, by depressing the movable component 2 in the direction of the arrow *a* (FIG. 2) down to its seat on the bottom part 1.

In the arrangement of FIG. 2, the cam 3 is fabricated of a magnetic material which provides a surface of attraction for magnet 4. In the modified arrangement of FIG. 3, the cam 3 is fabricated of nonmagnetic material and is provided with an insert 9 of magnetic material adjacent recess 3′.

Figure 5:
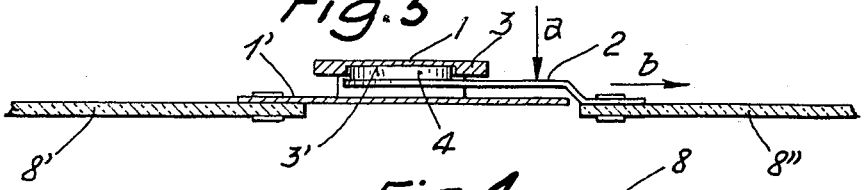
FIG. 5 shows a longitudinal section along the line XVIII—XVIII of FIG. 4.
Figure 4:
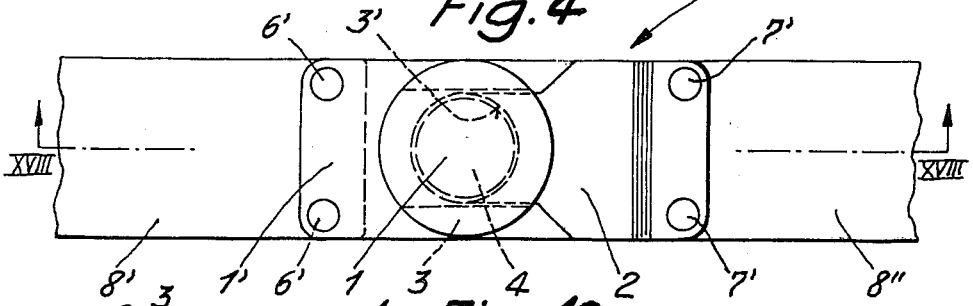
FIG. 4 shows a plan view of a second embodiment of the fastening device.

According to the embodiment shown in FIGS. 4 and 5 the bottom part 1′ of the fixed fastening component 1 is fixedly secured by means of the rivets 6′ to one end 8′, and the movable fastening component 2 is fastened by means of the rivets 7′ to the other end 8″ of a strap or a belt. This fastening device too is opened by depressing the movable fastening component 2 in the direction indicated in FIG. 5 by the arrow *a*, down to its seat on the bottom part 1′, and is pulled out from the fixed fastening device 1,1′ in the direction indicated by the arrow *b*.

Figure 7:
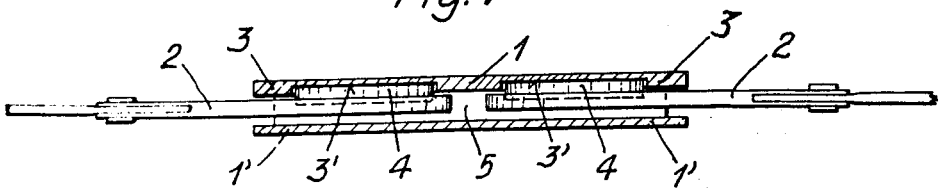
FIG. 7 shows a longitudinal section along the line XX—XX of FIG. 6.
Figure 6:
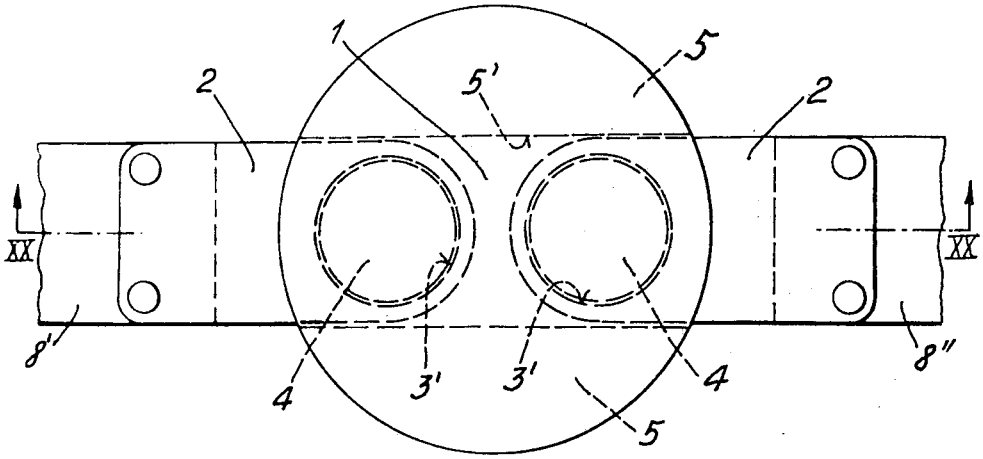
FIG. 6 shows a plan view of a third embodiment of the fastening device.
Figure 8:
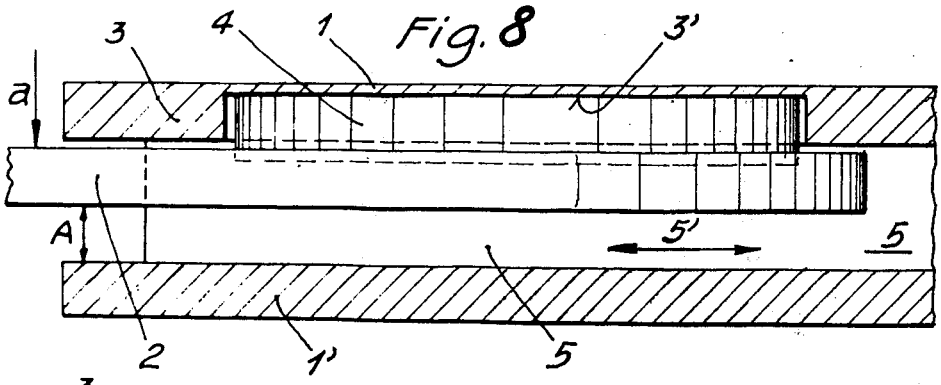
FIG. 8 shows a detail from FIG. 7 at a larger scale.
Figure 9:
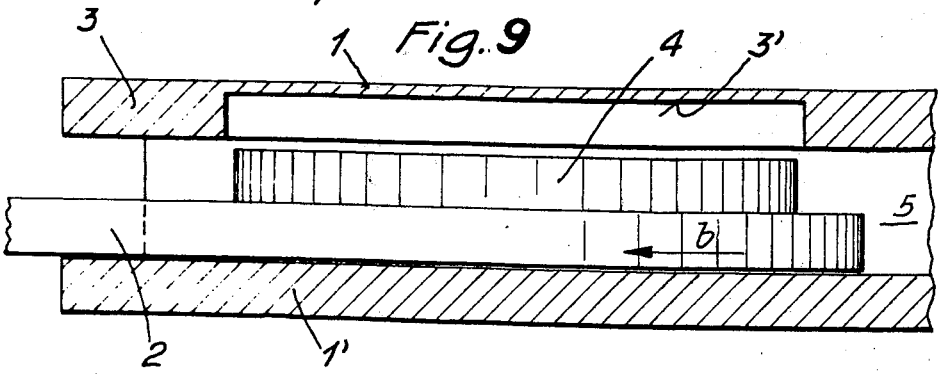
FIG. 9 shows a section similar to that of FIG. 8, the movable fastening component being shown in release position.

FIGS. 6 and 7 show a third embodiment of the fastening device which is particularly suited for use with belts and safety straps. A slideway 5′ for two movable fastening components 2 insertable from opposite sides is formed within a fixed fastening component comprising the cam 3 and two plates 1 connected by means of the lateral parts 5. On the inner side of the fixed fastening component 1 there are provided two recesses 3′ disposed at a longitudinal distance from one another and surrounded by the cam 3, which serve for engaging the magnets 4 of the movable fastening components 2. The latter are displaceable within the slideway 5′ in longitudinal direction. When the magnets 4 engaging the recess 3′ abut against the component 1 the distance A shown in FIG. 8 between the movable fastening component 2 and the bottom part 1′ is large enough to provide for the magnet 4 to completely leave the recess 3′, as shown in FIG. 9, when depressing the movable fastening component 2 in the direction indicated by the arrow *a*, until it abuts against the bottom part 1′. In this position the movable fastening component 2 can be pulled out from the slideway 5′ by moving it parallel to the latter in the direction indicated by the arrow *b*.

Figure 10:
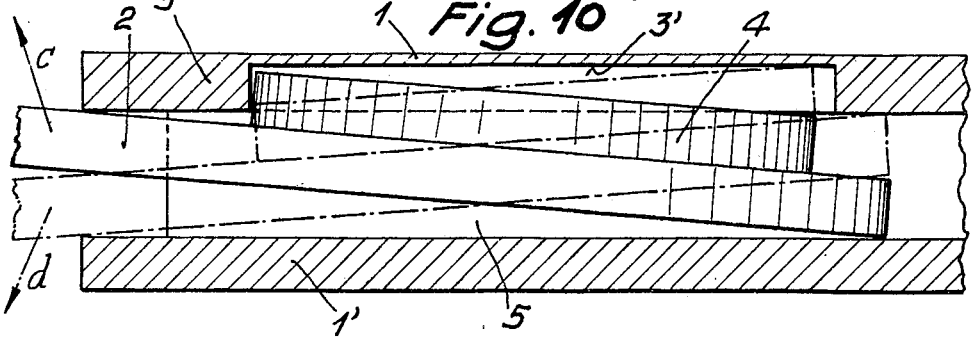
FIG. 10 shows the movable fastening component in two positions in which an unwanted opening of the device is prevented.

FIG. 10 shows that if the movable fastening component is not pulled in a parallel but rather in an oblique direction, as indicated by the arrows *c* and *d*, the opening of the fastening device is made impossible by the fact that the magnets 4 have not yet completely left the recess 3′ and are still in partial engagement therewith; this prevents any unwanted opening of the fastening device.

I claim:

1. A magnetic fastening device comprising first and second fastening components adapted to be attached respectively to two articles which are to be fastened to one another, said first fastening component comprising a fixed component having a pair of flat planar members and intervening lateral members for holding said pair of flat planar members in superposed, spaced, generally parallel relationship to one another to define an open-ended slideway therebetween, the spacing between said pair of flat planar members defining the height of said slideway and being substantially less than the widths and lengths of said pair of flat planar members, one of said flat planar members having an interior surface which faces the interior of said slideway and which as a recess therein, at least a portion of said recess being bounded by magnetic material, said second fastening component comprising an elongated, movable flat element adapted to be inserted into an open end of said slideway for slidable movement along said slideway in a direction parallel to the planes of said pair of flat planar members, a magnet attached to and upstanding from the one of the flat surfaces of said movable flat element which faces the interior recessed surface of said one of said flat planar members, said magnet being dimensioned to fit into said recess, the combined thickness of said flat movable element and the magnet attached thereto being less than the height of said slideway, whereby said first and second components may be fastened to one another by inserting said movable flat element into the open end of said slideway and thereafter sliding said movable element along said slideway in a first direction parallel to the planes of said pair of flat planar members until said upstanding magnet on said movable element is positioned in opposing relation to said recess whereafter said flat movable element and its attached magnet are moved in a second direction transverse to said first direction by the magnetic forces existing in said second direction to cause said magnet to enter into said recess and to be magnetically retained therein so as to prevent said first and second components from being detached from one another solely due to forces subsequently applied therebetween in directions parallel to said first direction, and whereby said first and second components may thereafter be unfastened from one another by first moving said movable element against said magnetic forces in a direction opposite to said second direction away from said one of said flat planar members and toward the other of said flat planar members in said slideway and then sliding said movable element along said slideway in a direction opposite to said first direction until said movable element has been withdrawn from the open end of said slideway.

2. The fastening device of claim 1 wherein said fixed component is attached to a bag or portfolio, and said movable flat element is attached to a flap of the bag or portfolio.

3. The fastening device of claim 1 wherein said one of said flat planar members is fabricated of a nonmagnetic material having an insert of magnetic material therein adjacent said recess.

4. The fastening device of claim 1 wherein said fixed component is attached to one end of a belt and said movable flat element is attached to the other end of said belt.

5. A magnetic fastening device comprising a fixed first fastening component provided with a cam having two recesses therein, two movable second fastening components each of which is provided with a magnet dimensioned to fit into one of said recesses for detachably holding said movable second components in engagement with said fixed first component by the magnetic force developed therebetween, said fixed first components having a bottom part and lateral parts forming a slideway which is open at its opposite ends, said slideway being adapted to receive said two movable fastening components by insertion thereof respectively into the opposite ends of said slideway, said two recesses being disposed at a longitudinal distance from one another on the inner side of said fixed fastening component for engagement respectively with the magnets carried by said two movable fastening components, the distance between said movable components and said bottom part of said fixed component being large enough to allow the lifting of each magnet out of its associated recess and subsequent sliding of said movable components out of the slideway by depressing said movable component toward said bottom part.

* * * * *